United States Patent [19]

Lindstrom

[11] 4,174,927

[45] Nov. 20, 1979

[54] REFRIGERATION COMPRESSOR LUBRICATION

[75] Inventor: Ivan T. Lindstrom, Sidney, Ohio

[73] Assignee: Copeland Corporation, Sidney, Ohio

[21] Appl. No.: 948,911

[22] Filed: Oct. 5, 1978

Related U.S. Application Data

[63] Continuation of Ser. No. 787,379, Apr. 14, 1977, abandoned.

[51] Int. Cl.[2] ..... F04B 17/00; F04B 35/00

[52] U.S. Cl. ..... 417/372; 417/902

[58] Field of Search ..... 417/372, 368, 902; 184/6.16, 6.18, 6.24

[56] References Cited

U.S. PATENT DOCUMENTS

| | | | |
|---|---|---|---|
| 2,500,751 | 3/1950 | Halfvarson | 417/372 X |
| 3,253,776 | 5/1966 | Parker | 417/372 |
| 3,965,880 | 6/1976 | Michael | 123/196 R |
| 4,111,612 | 9/1978 | Paczuski | 417/372 |

*Primary Examiner*—Carlton R. Croyle
*Assistant Examiner*—R. E. Gluck
*Attorney, Agent, or Firm*—Harness, Dickey & Pierce

[57] ABSTRACT

There is disclosed herein a lubrication system for a compressor which includes means for directing lubricant supplied to an upper bearing across the working surfaces thereof and returning this lubricant directly to the oil sump of the compressor thereby preventing lubricant from entering the compressor means which may result in slugging thereof. This oil return means includes an upper bearing which is provided with grooves on the working surface thereof which direct excess oil supplied to the bearing back to the oil sump while allowing a lubricating film of oil to remain between the adjacent bearing and crankshaft surfaces.

3 Claims, 6 Drawing Figures

REFRIGERATION COMPRESSOR LUBRICATION

This a continuation, of application Ser. No. 787,379, filed Apr. 14, 1977, now abandoned.

BACKGROUND AND SUMMARY OF THE INVENTION

The present invention relates generally to lubrication systems for compressors and more particularly to such systems which include means for returning oil from a compressor bearing directly to an oil sump.

Refrigeration compressors generally provide a motor drivingly connected to one end of a crankshaft rotatably journaled in a housing and have compressor means connected to the opposite end thereof. Passages are also provided in the crankshaft for supplying lubricant from an oil sump to each of the bearings supporting the crankshaft. In order to prevent slugging the compressor as well as to prevent lubricant from being carried away from the compressor and into the refrigeration system, it is desirable to direct excess lubricant supplied to the bearing away from the flowpath of the suction gas as it enters the compressing chambers. This is particularly important as regards the upper bearing in vertical crankshaft compressors which direct suction gas over the motor such as for cooling thereof as any lubricant leakage from this upper bearing into the area of the motor may be easily carried into the compressing chamber by the suction gas flowing adjacent thereto.

Various arrangements have been developed for directing excess lubricant from this upper bearing back to the oil sump, substantially all of which employ a two-piece upper bearing with some passage arrangement machined in the bearing housing which communicates with an annular space between the two upper bearing members. These passage arrangements are quite varied taking the form of inclined passages extending through the upper bearing housing or axially extending passages passing directly behind the bearing itself. In another arrangement, chevron grooves are provided on the surface of the crankshaft. While these arrangements may have varying degrees of effectiveness, they all require additional machining operations to be performed on the compressor housing and/or crankshaft which are expensive in terms of both time and labor required to set up and perform these machining operations.

Accordingly, the present invention provides a lubrication system for refrigeration compressors which includes a one-piece upper bearing having a plurality of passages provided on the work engaging surface thereof which function to effectively return excess lubricant to the oil sump. This lubricant return arrangement is substantially less costly to manufacture as it may be easily provided in the bearing during fabrication thereof. Further, it provides an effective means for returning excess lubricant from this area while also insuring that lubricant is dispersed over substantially the entire working surface of the bearing.

Additional advantages and features of the present invention will become apparent from the following description of the preferred embodiment taken in conjunction with the appended claims and the drawings.

BRIEF DESCRIPTION OF THE DRAWINGS

FIG. 5 is an enlarged view of a portion of the lower bearing housing and crankshaft of the refrigeration compressor of FIG. 1.

DESCRIPTION OF THE PREFERRED EMBODIMENT

Figure 1:
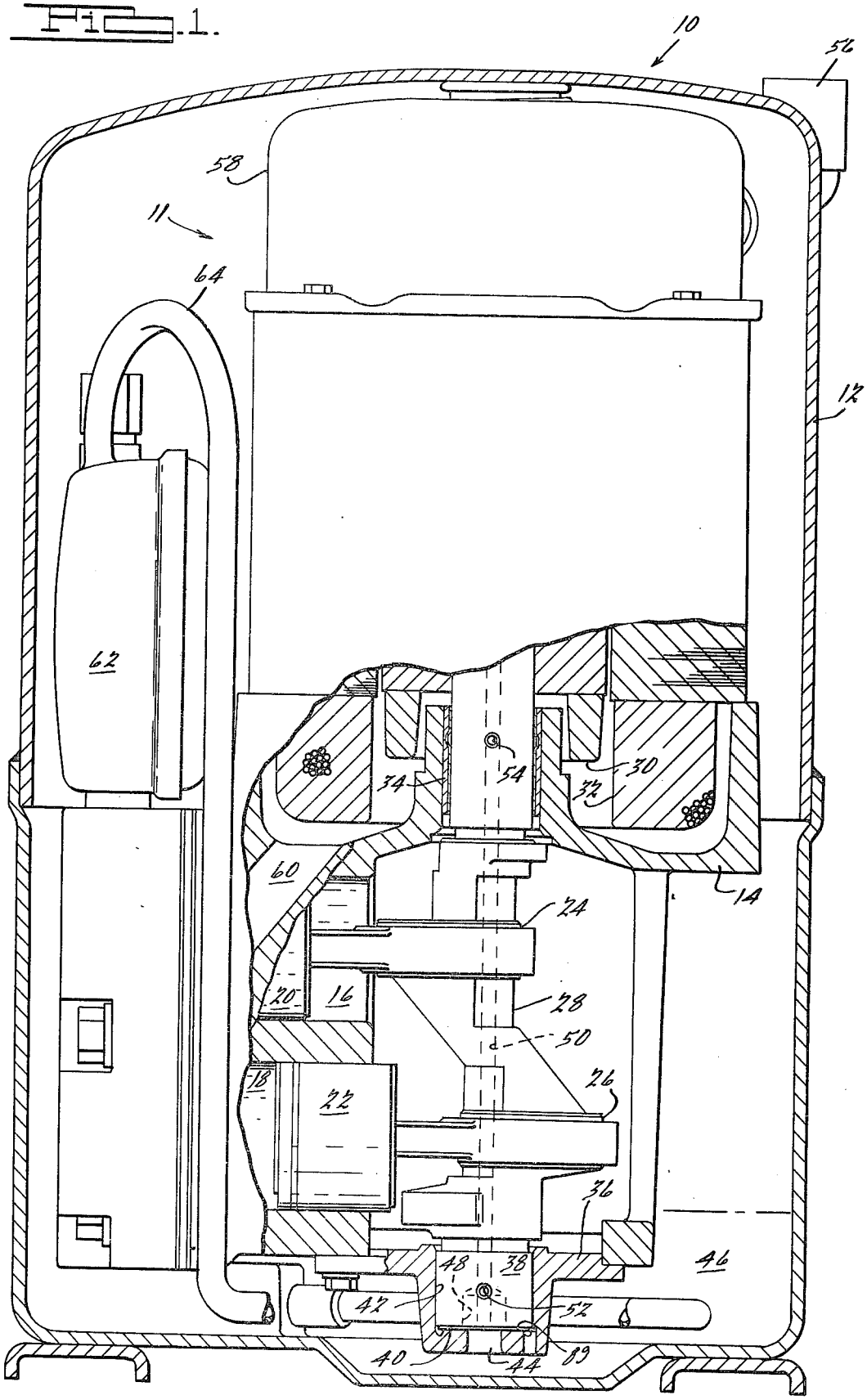
FIG. 1 is a partially sectioned elevational view of a refrigeration compressor in accordance with the present invention having portions thereof broken away.

Referring now to FIG. 1, there is shown a hermetic refrigeration compressor indicated generally at 10 comprising a hermetically sealed outer shell 12 in which is mounted a motor compressor 11 including a housing 14 having cylinders 16 and 18 in which pistons 20 and 22 are reciprocatingly disposed. Pistons 20 and 22 are journaled to throws 24 and 26 of vertically disposed crankshaft 26 so as to be reciprocated within cylinders 16 and 18. Crankshaft 28 has a motor rotor 30 secured to the upper end thereof surrounded by motor stator 32 secured to housing 14 which cooperates with rotor 30 so as to rotatably drive crankshaft 28. Housing 14 is also provided with an upper bearing 34 in which an upper portion of crankshaft 28 is journaled and a lower bearing housing member 36 in which the lower end 38 of crankshaft 28 is journaled. Lower bearing housing member 36 includes both axial and radial thrust bearings 40 and 42 respectively. An axial extending opening 44 is provided in the bottom portion of lower bearing housing 36 which allows lubricant from oil sump 46 provided in the bottom portion of outer shell 12 to flow inwardly to central axially extending bore 48 provided in end 38 of crankshaft 28. An eccentric longitudinally extending passage 50 in crankshaft 28 communicates with central bore 48 so as to cooperate therewith to supply lubricant to both throws 24 and 26 as well as upper bearing 34. A radially extending bore 52 is also provided in crankshaft 28 communicating with central bore 48 to supply lubricant to radial thrust bearing 42 in lower bearing housing 36. In like manner, a radial passage 54 communicates with eccentric bore 50 in crankshaft 28 to supply lubricant to upper bearing 34.

In the particular embodiment illustrated, compressor 10 is provided with a shroud 58 defining a motor compartment enclosing motor stator 32 and rotor 30. Outer shell 12 is provided with a suction gas inleet 56 which conducts suction gas into the interior thereof from which it will be directed through openings in shroud 58 across the motor stator 32 and rotor 30 so as to cool same and thence downwardly through passage 60 provided in housing 14 and into cylinders 16 and 18. Reciprocating pistons 20 and 22 will then compress the refrigerant gas causing it to be expelled into discharge muffler 62 from which it is transmitted through discharge line 64 which extends downwardly through the oil sump 46 and through shell 12.

Figure 2:
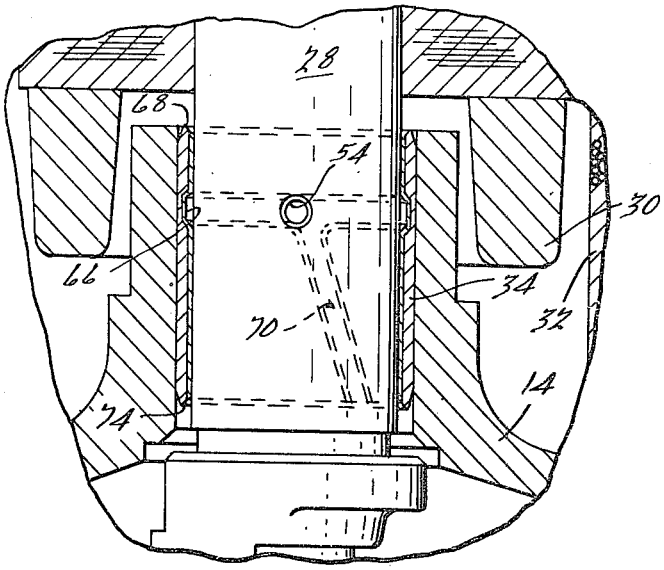
FIG. 2 is an enlarged view of a portion of the refrigeration compressor of FIG. 1 showing the upper bearing and corresponding portion of the crankshaft.
Figure 3:
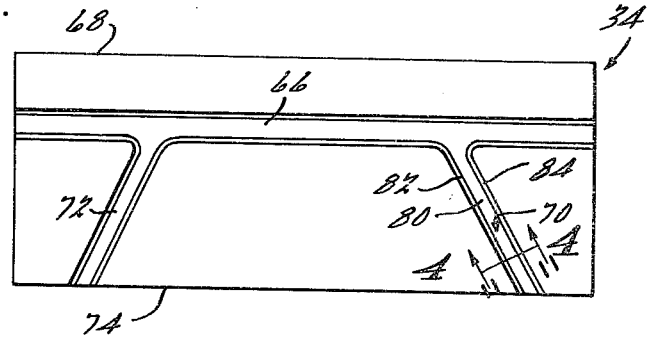
FIG. 3 is a fully developed view of the upper bearing shown in FIGS. 1 and 2.

In order to prevent excess lubricant supplied to upper bearing 34 from being carried through passage 60 into cylinders 16 and 18, it is desirable to provide means associated with upper bearing 34 to return this lubricant directly to oil sump 46. Accordingly, as best seen in FIG. 2, upper bearing 34 is provided with an annular groove 66 spaced slightly below the upper end 68 thereof. A pair of generally axially downwardly extending spiralled grooves 70 and 72 of opposite hand are provided which communicate with annular groove 66 at their upper end and open out the bottom end 74 of bearing 34. While generally axially extending grooves 70 and 72 may be positioned parallel to one another, should this be desired, it will generally be preferable to spiral these grooves in opposite directions so as to disperse the bearing loading forces exerted upon bearing 34. Further, grooves 70 and 72 will preferably be spaced approximately 180° apart and positioned in housing 14 so as to engage crankshaft 28 at points of minimal radial thrust.

Figure 4:
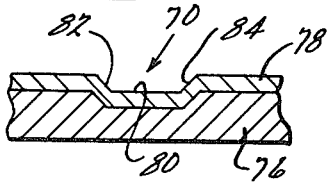
FIG. 4 is a sectioned view of a portion of the bearing of FIG. 3 taken along line 4—4 thereof.
Figure 9:
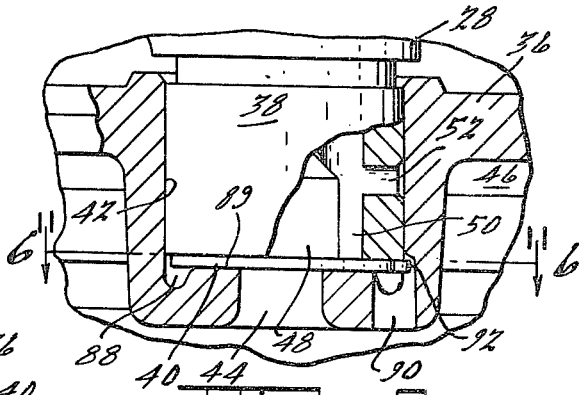

As best seen in FIGS. 2 and 4, upper bearing 34 will preferably be comprised of a base member 76 fabricated from suitable materials such as a low carbon steel for example which has applied to it a layer of bearing material 78 in any suitable manner. As the cross sectional shape of each of grooves 66, 70 and 72 is substantially identical, only a single cross section will be described. As best seen with reference to FIG. 4, groove 70 is defined by a bottom portion 80 and upwardly extending diverging sidewall portions 82 and 84. These grooves may be provided in any suitable manner such as by coining or even cutting the bearing material and/or base member either before or preferably after the bearing material 78 has been applied to the base member. Sidewall portions 82 and 84 are inclined as shown in order to prevent grooves 70 and 72 from acting as lubricant scrapers which would remove the film of oil from rotating crankshaft 28. The depth of grooves 66, 70 and 72 should be sufficient to allow any foreign particles entrained in the oil to pass therethrough without scoring the surface of crankshaft 28.

In operation, lubricant will be conducted from oil sump 46 through opening 44 into bore 48 whereupon centrifugal forces will cause it to flow upwardly through eccentric passage 50 and through radial passage 54 which communicates with annular groove 66 to thereby lubricant upper bearing 34. Annular groove 66 will then direct the lubricating oil around the circumference of bearing 34 with the excess lubricant oil being returned through either passage 70 or 72 directly to the oil sump 46. It should be noted that while only a single spiralled generally axially extending passage 70 or 72 need be provided, it is generally desirable to provide two such passages which are of opposite band so as to insure that the oil return system thus defined is operative in either direction of rotation of rotor 30 and crankshaft 28.

Often, the lubricant of refrigerant compressors will contain foreign particles such as may be picked up by the refrigerant gas in its circulation through the evaporator and/or condenser or as may be generated from wear during initial running in periods or subsequent operation of the compressor. These foreign particles will generally settle out of the lubricant during periods of non-use but the agitation created by start up as well as entry of slugs of liquid refrigerant will be sufficient to cause some particles to be drawn into the lubricant pumping means. These particles may then be circulated to the bearings resulting in possible scoring or excessive wear of the bearings and/or crank surfaces. Accordingly, compressor 10 is also provided with a means for separating these foreign particles from the lubricant and returning them to the oil sump 46 thereby preventing such particles from damaging the bearings.

Figure 6:
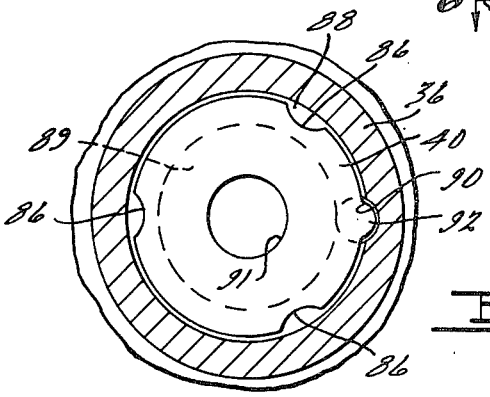
FIG. 6 is a sectioned view of the lower bearing housing of FIG. 5 including the axial thrust bearing, the section being taken along line 6—6 thereof.

As best seen with reference to FIGS. 5 and 6, axial thrust bearing 40 is provided with a plurality of spaced arcuate shaped notches 86 provided around the circumference thereof which open into an annular groove 88 provided in lower bearing housing member 36. As shown therein, annular groove 88 is spaced radially outwardly from central opening 44 provided in lower bearing housing and is generally U-shaped in cross section. Annular groove 88 also acts as a relief groove for machining bearing surface 42 and axial thrust bearing supporting surface 89. A passageway 90 is also providing in lower bearing housing 36 extending between annular groove 88 and oil sump 46. Axial thrust bearing 40 also has a central passage 91 provided therein which aligns with opening 44 in lower bearing housing 36 to allow oil to flow from sump 48 into bore 48. Also, as shown in FIG. 6, axial thrust bearing 40 is provided with a radially outwardly projecting tab portion 92 which is received in and cooperates with an extension of passage 90 so as to prevent rotation of axial thrust bearing 40.

In operation, as best seen in FIG. 5, lubricant which may contain foreign particles will be drawn upwardly from oil sump 46 through bore 44 into central bore 48 of crankshaft 28. Centrifugal force due to the rotation of crankshaft 28 will cause the lubricant to flow radially outwardly from central passage 48 into passage 50 from whence it will be conducted upwardly to lubricate the crankshaft throws 24 and 26 and upper and lower bearings 34 and 42 respectively. As the foreign particles are heavier than the lubricant, they will be caused to separate and to settle downwardly onto the axial thrust bearing 40 or possibly some may be thrown out through radial passage 52 as well. Centrifugal force and the lubricant pressure thus generated will cooperate to flush these foreign particles across the crankshaft engaging surface of axial thrust bearing 40 and bearing surface 42 downwardly through arcuate notches 86 provided on thrust bearing 40 and into annular groove 88. Excess lubricant flow will provide a continuous flushing action which will aid in preventing an excessive build up of particles in annular groove 88 by washing these particles through passage 90 back into oil sump 46 thereby preventing their passage upwardly to throws 24 and 26 and upper bearing 34 so as to protect these bearing surfaces against excessive wear or premature failure. It should be noted that arcuate notches 86 will be of a depth so as to prevent direct communication between eccentric passage 50 and annular groove 88 thereby insuring that adequate oil pressure will be generated by the centrifugal pump arrangement to provide adequate lubrication to both crankshaft throws 24 and 26 as well as upper bearing 34. Further, as a plurality of notches 86 are provided in axial thrust bearing 40, the foreign particles will still be effectively removed from the lubricant even should one or two of these passages become clogged. The continuous flushing action of the lubricant flowing over axial thrust bearing 40 as well as radial thrust bearing 42 and exiting through notches 86 will continuously wash particles across these respective surfaces into annular groove 88 and through passage 90 thereby preventing excessive accumulations therein from defeating the operation of this particle separator.

While it will be apparent that the preferred embodiment of the invention disclosed is well calculated to provide the advantages above stated, it will be appreciated that the invention is susceptible to modification, variation, and change without departing from the proper scope or fair meaning of the subjoined claims.

I claim:

1. A refrigeration compressor comprising a housing, compressor means disposed within said housing, an oil sump containing lubricant, a vertical crankshaft drivingly connected to said compressor means, motor means for rotatably driving said crankshaft, bearing means including an upper bearing provided in said housing, said crankshaft being rotatably journaled in said bearing means, lubrication means in said crankshaft for supplying lubricant from said sump to said bearing means, and return means on said upper bearing for returning lubricant from said upper bearing to said sump via a path disposed between said uppeer bearing and said crankshaft, said return means including a continuous annular groove on the crankshaft engaging surface of said upper bearing, said annular groove being located closer to the upper end of said upper bearing than to the lower end thereof, said return means further including a pair of generally axially extending grooves provided on said crankshaft engaging surface of said upper bearing, said generally axial grooves being circumferentially spaced, spiralled, of opposite hand and extending only from said annular groove to the lower edge of said upper bearing whereby said return means is operative to prevent lubricant from entering said compressor means.

2. A compressor as set forth in claim 1 wherein said generally axially extending grooves are circumferentially disposed on said upper bearing in areas where said crankshaft exerts less than maximum radial thrust on said upper bearing.

3. A compressor as set forth in claim 1 wherein said generally axial and annular grooves are defined by a bottom portion and radially inwardly diverging sidewall portions.

* * * * *